US006147570A

United States Patent [19]

Gill

[11] Patent Number: 6,147,570

[45] Date of Patent: Nov. 14, 2000

[54] MONOLITHIC INTEGRATED INTERDIGITAL COUPLER

[75] Inventor: Hardial Gill, Backnang, Germany

[73] Assignee: Robert Bosch GmbH, Stuttgart, Germany

[21] Appl. No.: 09/358,236

[22] Filed: Jul. 21, 1999

[30] Foreign Application Priority Data

Nov. 10, 1998 [DE] Germany ..... 198 51 740

[51] Int. Cl.[7] ..... H01P 5/18

[52] U.S. Cl. ..... 333/116; 333/246

[58] Field of Search ..... 333/116

[56] References Cited

U.S. PATENT DOCUMENTS 4,375,054 2/1983 Pavio ..... 333/116
4,937,541 6/1990 Podell et al. ..... 333/116
5,075,646 12/1991 Morse ..... 333/116

OTHER PUBLICATIONS

"Integrierte Mikrowellenschaltungen", by Reinmut K Hoffmann, Springer–Verlag 1983, pp. 260–262.

*Primary Examiner*—Paul Gensler
*Attorney, Agent, or Firm*—Michael J. Striker

[57] ABSTRACT

The monolithic integrated interdigital coupler includes a plurality of parallel conductors (5, 6, 7, 8, 9) extending side-by-side and a plurality of conducting air bridges (10, 11,12, 13) connecting pairs of conductors. One end of each conductor is connected with one end of another non-adjacent or non-neighboring conductor by means of one of the conducting air bridges (10,11,12,13). In order to provide a closer or tighter coupling at least one conducting air bridge (10,11,12,13) is connected to the conductor it bridges by a concentrated capacitance (14,15,16,17).

4 Claims, 1 Drawing Sheet

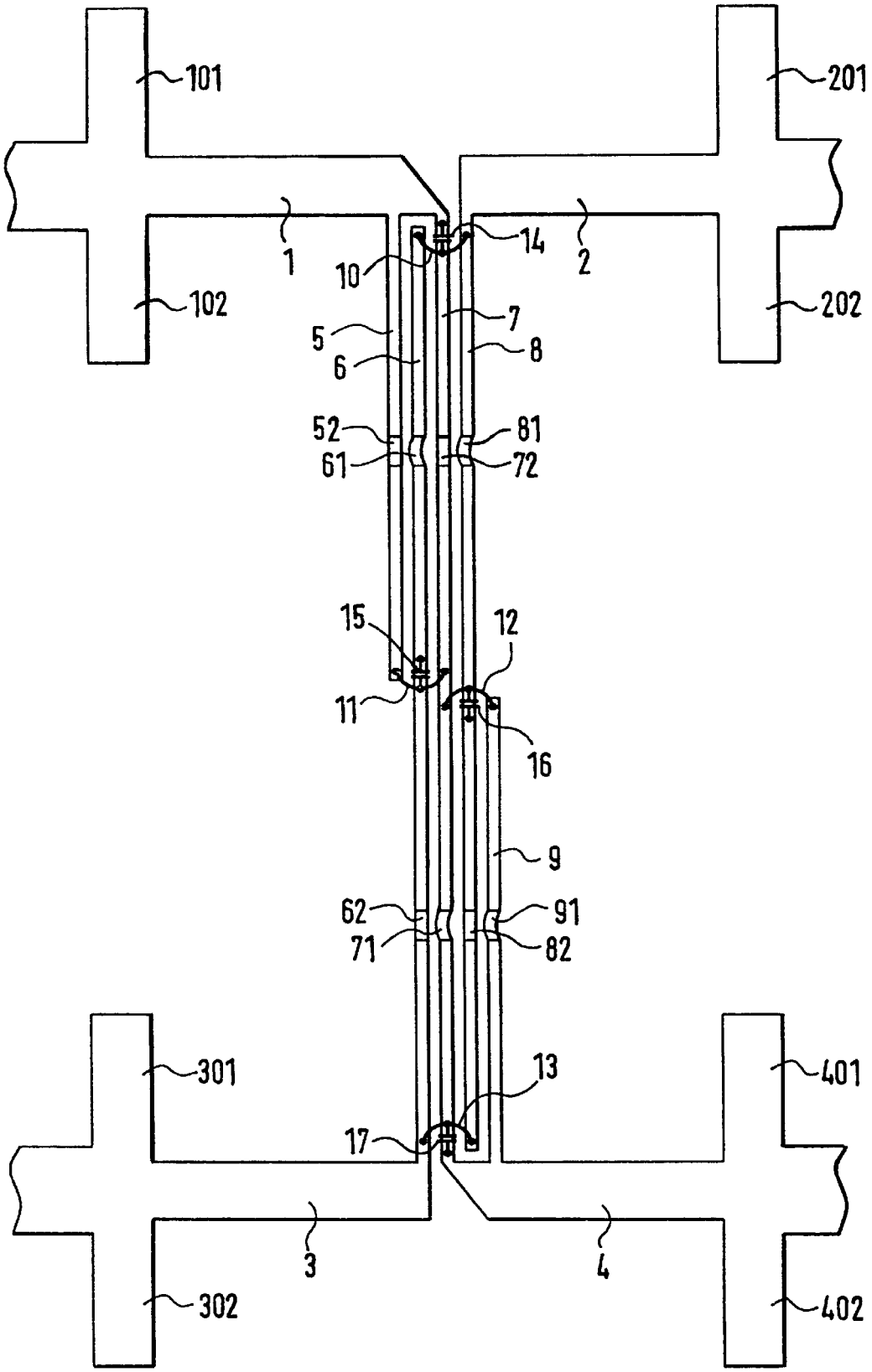
101
201
1
2
14
10
102
202
7
5
8
6
52
81
61
72
15
12
11
16
9
62
91
71
82
301
13
401
17
3
4
302
402

MONOLITHIC INTEGRATED INTERDIGITAL COUPLER

BACKGROUND OF THE INVENTION

1. Field of the Invention

The present invention relates to a monolithic integrated interdigital coupler comprising a plurality of parallel side-by-side conductors and, more particularly, to a monolithic integrated interdigital coupler including a plurality of parallel side-by-side conductors, wherein the end of each conductor is connected with a conductor not immediately adjacent to it by means of a conducting air bridge.

2. Prior Art

This type of inter digital coupler, which is often called a "Lange-coupler" in the literature, is disclosed in the textbook, "Integrated Microwave Circuitry (Integrierte Mikrowellenschaltungen)", by R. K. Hoffmann, Springer-Verlag, 1983, pp. 260 to 262. A very close or tight coupling can be obtained with an interdigital circuit structure. When an interdigital coupler is to be monolithically integrated, the conductor widths and distances between the conductors must be less than 8 $\mu$m in order for example to obtain good electrical properties. This type of small conductor strip and spacing between the conductor are however very difficult to obtain with state of the art circuit technology. Thus if a monolithic integrated interdigital coupler of the above-described type is to be made easily, even with larger conductor widths and larger distances between the conductors, a very high degree of coupling must be achieved.

SUMMARY OF THE INVENTION

It is an object of the present invention to provide an improved monolithic integrated interdigital coupler of the above-described type which has a very high degree of coupling and which may be made with current circuit technology.

According to the invention the monolithic integrated interdigital coupler comprises a plurality of parallel conductors extending side-by-side, wherein an end of each conductor is connected with an end of another conductor not immediately next to or adjacent to it, i.e. a non-neighboring conductor, via a conducting air bridge and a concentrated capacitance is connected at least between one conducting air bridge and the conductor bridged by it.

Advantageously the at least one concentrated capacitance used increases the degree of coupling of the coupler so that it is not necessary to provide conductors with very small widths or very small spacing between the conductors. Furthermore the directional property of the coupler is improved, because the propagation velocity of the even and odd modes in the coupled range are equalized to each other. The conductor lengths in the coupling range are also reduced by using the at least one concentrated capacitance.

In a preferred embodiment the bandwidth of the coupler can be increased when connecting lines to gates of the coupler are provided with open circuit stubs in order to reduce the reflections at the gates as much as possible.

BRIEF DESCRIPTION OF THE DRAWING

The objects, features and advantages of the invention will now be illustrated in more detail with the aid of the following description of the preferred embodiments, with reference to the accompanying sole FIGURE which is a top plan view of a monolithic integrated interdigital coupler mounted on a substrate.

DESCRIPTION OF THE PREFERRED EMBODIMENT

The interdigital coupler shown in the drawing is a 3-dB coupler with four gates 1, 2, 3 and 4 embodied as conductors. The four gates 1, 2, 3 and 4 are coupled by five parallel conductors 5, 6, 7, 8 and 9 extending side-by-side so that e.g. power fed to gate 1 is divided into equal parts in the respective gates 2 and 4, but the gate 3 is completely uncoupled.

The five conductors 5, 6, 7, 8 and 9 are coupled with each other in a known way (as with a "Lange-coupler") and are connected with the individual gates 1, 2, 3 and 4 in the manner described in the following.

Both conductors 5 and 7 are connected with the gate 1. The conductor 6 ends before the gate 1 and is connected with the gate 3. The conductor 6 is arranged between both conductors 5 and 7. The conductor 7 is connected with both gate 1 and with the gate 4. The conductor 8 extending immediately beside or neighbors the conductor 7 is connected to the gate 2 at one end and ends at the other end in front of the gate 4. The conductor 9 immediately adjacent to the conductor 8 is connected at one end with the gate 4 and is open at the other end. In this way an interdigital system of conductors engaged with each other arises, in which the conductors 5, 6, 8 and 9 have one open, unconnected end which is not connected with one of the gates 1, 2, 3 or 4. In the embodiment shown both outer conductors 5 and 9 end in the embodiment are approximately half the length of the coupler.

In order to obtain the desired 3-dB coupling action, the free ends of the conductors are connected with non-neighboring conductors by means of conducting air bridges 10,11,12,13. Thus an air bridge 10 is provided between the free end of conductor 6 and the conductor 8. An air bridge 11 is provided between the free end of the conductor 5 and the conductor 7. An air bridge 12 is provided between the free end of the conductor 9 and the conductor 7. Also an air bridge 13 is provided between the free end of the conductor 8 and the conductor 6.

At an operating frequency of the coupler in the millimeter wavelength range and with a substrate thickness of less than 100 $\mu$m, the conductors 6, 7, 8, 9 must be very small (less than 8 $\mu$m) and above all the distance between the conductors must be very small (less than 8 $\mu$m). This small conductor width and spacing between the conductors is very difficult to obtain with current circuit engineering methods. In order to be able to provide the required close or tight coupling between the conductors in spite of that, a concentrated capacitance is connected between each of the air bridges 10, 11, 12 and 13 and each of the conductors bridged by the respective air bridge. Thus a concentrated capacitance 14 is connected between the air bridge 10 and the conductor 7. A concentrated capacitance 15 is connected between the air bridge 11 and the conductor 6. A concentrated capacitance 16 is connected between the air bridge 12 and the conductor 8. A concentrated capacitance 17 is connected between the air bridge 13 and the conductor 7. Also smaller concentrated capacitance suffices to provide the required coupling under these circumstances than is shown in the embodiment. The capacitances 14, 15, 16 and 17 have a value of about 0.1 pF at a coupler operating frequency of about 26 GHz.

Conductor widths and spacing of only 10 to 15 $\mu$m are now required in a GaAs substrate with a thickness of 100 82 m and at a dielectric constant of $\epsilon$=12.9 with concentrated capacitances increasing the coupling.

No exactly constant conductor widths can be obtained by etching the conductor strips 5, 6, 7, 8 and 9. Particularly a certain amount of widening of the conductor occurs in the center of the conductor about 200 to 300 $\mu$m from the ends of the conductor. This widening leads also to a reduction of the spacing between the conductors, whereby the coupling degree is influenced. In order to avoid this undesirable effect caused by the circuitry technology manufacturing methods, conductive material is removed over a length of about 40 to 50 $\mu$m from all conductor strips 5, 6, 7, 8 and 9 at the locations where they are widened to form interruptions. Subsequently the interruptions are again closed. Moreover conducting air bridges 61, 81, 71 and 91 (e.g. gold bands) are used in conductors not directly next to each other to close the breaks. The other interruptions are bridged by conducting layers 52, 72, 62 and 82 grown on the substrate, which are not subsequently coated with a gold layer as with the other conductor strips. By omitting the gold layer the desired distance between the air bridges 61, 81, 71 and 91 and the adjacent conducting layers 52, 72, 62 and 82 can be maintained.

In order to obtain the largest possible bandwidth of the coupler the gates 1, 2, 3 and 4 are provided with conductor pieces 101, 102, 201, 202, 301, 302, 401, 402 for low reflection matching.

The disclosure in German Patent Application 198 51 740.8-35 of Nov. 10, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a monolithic integrated interdigital coupler, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A monolithic integrated interdigital coupler comprising a plurality of parallel conductors (5, 6, 7, 8, 9) extending side-by-side, a plurality of conducting air bridges (10,11,12, 13) and at least one concentrated capacitance (14,15,16,17), wherein one end of each of said conductors is connected with one end of another non-adjacent or non-neighboring one of said conductors by means of a respective one of said conducting air bridges (10,11,12,13) and at least one of said conducting air bridges (10,11,12,13) is connected to one of said conductors bridged thereby by said at least one concentrated capacitance (14,15,16,17).

2. The monolithic integrated interdigital coupler as defined in claim 1, further comprising gates (1,2,3,4) connected with said conductors (5,6,7,8,9) and conductor pieces (101,102,201,202,301,302,401,402) extending from said gates for reflection-free matching.

3. The monolithic integrated interdigital coupler as defined in claim 1, wherein each of said conducting air bridges is connected with said one of said conductors bridged thereby by said at least one concentrated capacitance (14,15,16,17).

4. A monolithic integrated interdigital coupler comprising a plurality of parallel conductors (5, 6, 7, 8, 9) extending side-by-side;

a plurality of gates (1,2,3,4) connected to said conductors (5, 6, 7, 8, 9), said gates having conductor pieces (101,102,201,202,301,302,401,402) extending therefrom for reflection-free matching;

a plurality of conducting air bridges (10,11,12, 13), each of said conducting air bridges connecting a respective one of said conductors (5, 6, 7, 8, 9) with another non-adjacent or non-neighboring one of said conductors; and at least one concentrated capacitance (14,15,16,17) connecting each of said conducting air bridges (10,11,12, 13) with a bridged one of said conductors bridged thereby.

* * * * *